US008899342B2

(12) United States Patent
Chesley

(10) Patent No.: US 8,899,342 B2
(45) Date of Patent: Dec. 2, 2014

(54) SAFETY APPARATUS

(76) Inventor: Lyle H Chesley, Homer, AK (US)

( * ) Notice: Subject to any disclaimer, the term of this patent is extended or adjusted under 35 U.S.C. 154(b) by 728 days.

(21) Appl. No.: 12/221,113

(22) Filed: Jul. 31, 2008

(65) Prior Publication Data

US 2010/0025053 A1 Feb. 4, 2010

(51) Int. Cl.

| | |
|---|---|
| ***A62C 3/06*** | (2006.01) |
| ***A62C 3/00*** | (2006.01) |
| ***A62C 8/00*** | (2006.01) |
| ***A62C 99/00*** | (2010.01) |
| ***A62C 37/40*** | (2006.01) |
| ***A62C 3/16*** | (2006.01) |

(52) U.S. Cl.

CPC ..... *A62C 3/16* (2013.01); *A62C 99/0036* (2013.01); *A62C 37/40* (2013.01)

USPC ..... 169/56; 169/48; 169/49; 169/54

(58) Field of Classification Search

USPC ..... 169/46, 48, 49, 51, 56, 59, 60, 68, 67, 169/57, 6, 687

See application file for complete search history.

(56) References Cited

U.S. PATENT DOCUMENTS

| | | | | | |
|---|---|---|---|---|---|
| 2,051,853 | A | * | 8/1936 | Hodgman, Jr. | 337/336 |
| 2,822,877 | A | * | 2/1958 | Post | 169/28 |
| 2,908,334 | A | * | 10/1959 | Duggan et al. | 169/44 |
| 3,403,733 | A | * | 10/1968 | Terry | 169/49 |
| 3,593,801 | A | * | 7/1971 | De Palma | 169/27 |
| 3,768,567 | A | * | 10/1973 | Weise | 169/26 |
| 4,055,829 | A | * | 10/1977 | Ruegsegger | 337/416 |
| 4,135,055 | A | | 1/1979 | Beckers et al. | |
| 4,276,332 | A | | 6/1981 | Castle | |
| 4,596,483 | A | * | 6/1986 | Gabriel | 403/28 |
| 4,711,307 | A | * | 12/1987 | Rosen | 169/57 |
| 5,040,610 | A | | 8/1991 | Blanchong | |
| 5,441,113 | A | | 8/1995 | Pierce | |
| 5,546,711 | A | | 8/1996 | Heller | |
| 5,654,684 | A | * | 8/1997 | Boyden | 340/287 |
| 5,868,205 | A | | 2/1999 | Cunningham et al. | |

(Continued)

FOREIGN PATENT DOCUMENTS

EP 0966732 B1 2/1998

OTHER PUBLICATIONS

Homer Tribune, Neighbors,Jan. 5, 2005, Homer, Alaska, US.
Homer News, Business,Apr. 17, 2008, Homer, Alaska, US.

*Primary Examiner* — Len Tran
*Assistant Examiner* — Thomas Berez
(74) *Attorney, Agent, or Firm* — Southeast IP Group, LLC.; Thomas L. Moses

(57) ABSTRACT

A safety apparatus is disclosed for inhibiting an outbreak of an electrical fire within an electrical box. The apparatus includes a heat sensitive device which is disposed within the electrical box for sensing a potentially hazardous temperature rise within the electrical box caused by an electrical fault in the electrical box. A control device is associated with the heat sensitive device such that the control device is activated by the heat sensitive device when the heat sensitive device senses the potentially hazardous temperature rise within the electrical box. The electrical fire inhibiting device has a dormant mode and a fire extinguishing mode. The arrangement is such that when the control device is activated by the heat sensitive device, the control device switches the fire inhibiting device from the dormant mode to the fire extinguishing mode so that the outbreak of the electrical fire within the electrical box is prevented.

12 Claims, 7 Drawing Sheets

(56) References Cited

U.S. PATENT DOCUMENTS

| | | | | |
|---|---|---|---|---|
| 6,003,608 | A | 12/1999 | Cunningham | |
| 6,003,609 | A | 12/1999 | Walls | |
| 6,105,334 | A | 8/2000 | Monson et al. | |
| 6,138,766 | A * | 10/2000 | Finnerty et al. | 169/14 |
| 6,340,058 | B1 | 1/2002 | Dominick et al. | |
| 6,648,077 | B2 | 11/2003 | Hoffman | |
| 6,838,618 | B2 | 1/2005 | Newbold et al. | |
| 6,866,102 | B2 * | 3/2005 | Boyce et al. | 169/61 |
| 7,064,947 | B1 * | 6/2006 | Chisolm | 361/111 |
| 2002/0043978 | A1 | 4/2002 | McDonald | |
| 2007/0007020 | A1 * | 1/2007 | Chase | 169/57 |
| 2009/0032272 | A1 * | 2/2009 | Duncan | 169/85 |

* cited by examiner

SAFETY APPARATUS

BACKGROUND OF THE INVENTION

1. Field of the Invention

The present invention relates to a safety apparatus for inhibiting an outbreak of an electrical fire within an electrical box.

More specifically, the present invention relates to a safety apparatus for inhibiting an outbreak of an electrical fire within an electrical box such as an electrical breaker box or an electrical junction or outlet box.

2. Background Information

According to the National Fire Protection Agency, the estimated annual casualties in America are: 320 deaths caused by electrical fires, 1,700 injuries and the losses associated with residential wiring systems of $797,000,000.00 as of 1991

Many of these fires begin in the "breaker box". A relatively new device, the AFCI (arc-fault circuit interrupter), is required by code in new construction homes, but there are no devices designed specifically to combat a potential electrical fire when ignition-level heat is detected in the load center enclosure.

In most standard electrical load center enclosures there is oxygen and "fuel" in the form of plastic components, paper insulation, and the like. All that is needed is an adequate amount of heat to ignite the "fuel". Weak, loose, or faulty electrical connections generate heat. The heat as a source of ignition can happen at low enough amperes to avoid detection by a circuit breaker, and breakers can simply fail to operate.

The outbreak of an electrical fire could be prevented by removing oxygen when ignition-level heat is detected. All electrical load centers are enclosed in a plastic or metal box.

The present invention prevents the outbreak of an electrical fire so that as an electrical connection fails and begins to heat up, a thermal sensing device detects the rise in temperature and actuates a mechanism to inject a fire-inhibiting mixture to displace all oxygen within the enclosure, indefinitely. Without oxygen, the faulty wiring cannot ignite and a fire is prevented.

More specifically, according to the present invention, when sufficient heat is present, a thermal strip warps, then Jewelers thread is pulled by the warping action of the thermal strip and opens a spring-loaded actuation mechanism. A mixing valve is opened for combining the foaming agent with liquid and vapor propellant thus injecting the fire inhibiting mixture into the enclosure.

The device is designed with many necessary properties in mind. Among these are the suppression efficiency, re-ignition prevention, residue level, electrical conductivity, corrosiveness, stability, and current environmental standards.

The apparatus according to the present invention can be quickly mounted on almost all load centers, meter bases, receptacle boxes, or any enclosure that might contain electrical connections. Also, the apparatus of the present invention can be adapted to interface with an existing fire alarm system.

Yet another advantage of the apparatus according to the present invention is that no electricity is required for operation thereof. Also, the apparatus according to the present invention develops no heat or noise.

The most compelling advantage to the apparatus according to the present invention is the potential reduction in fire casualties and loss. The United States Center for Disease Control recently issued a Public-Private Fire Safety Council Challenge: to eliminate residential fire deaths by 2020.

The apparatus according to the present invention has the potential to reduce the number of electrical fires significantly, possibly saving hundreds of lives each year. If every breaker box were protected from fire, millions of dollars in damage could also be saved.

Therefore, the primary feature of the present invention is the provision of a safety apparatus that overcomes the problems associated with the prior art fire prevention devices and which makes a significant contribution to the fire safety apparatus art.

Another feature of the present invention is the provision of a safety apparatus that reduces the possibility of an outbreak of an electrical fire along with the attendant loss of life, injury and property loss.

Other features and advantages of the present invention will be readily apparent to those skilled in the art by a consideration of the detailed description of a preferred embodiment of the present invention contained herein.

SUMMARY OF THE INVENTION

The present invention relates to a safety apparatus for inhibiting an outbreak of an electrical fire within an electrical box. The apparatus includes a heat sensitive device which is disposed within the electrical box for sensing a potentially hazardous temperature rise within the electrical box caused by an electrical fault in the electrical box. A control device is associated with the heat sensitive device such that the control device is activated by the heat sensitive device when the heat sensitive device senses the potentially hazardous temperature rise within the electrical box. An electrical fire inhibiting device is operably connected to the control device. The electrical fire inhibiting device has a dormant mode and a fire extinguishing mode. The arrangement is such that when the control device is activated by the heat sensitive device, the control device switches the fire inhibiting device from the dormant mode to the fire extinguishing mode so that the outbreak of the electrical fire within the electrical box is prevented.

In a more specific embodiment of the present invention, the heat sensitive device includes a bimetallic strip which warps in response to the potentially hazardous temperature rise within the electrical box.

More specifically, the heat sensitive device includes a thermal strip, the thermal strip including a first metallic portion having a first and a second end.

A second metallic portion is fabricated from a metal having a different coefficient of thermal expansion relative to a coefficient of thermal expansion of the first metallic portion. The second portion has a first and a second extremity. The arrangement is such that the first end of the first metallic portion and the first extremity of the second metallic portion are joined together. Also, the second end of the first metallic portion and the second extremity of the second metallic portion are joined together. The arrangement is such that when the potentially hazardous temperature rise is present within the electrical box, the first and second metallic portions warp in response to the potentially hazardous temperature rise within the electrical box due to the difference in the coefficients of thermal expansion of the respective metallic portions.

The control device includes jeweler's thread having a first and a second termination. The first termination of the jeweler's thread is connected to the heat sensitive device adjacent to the second end and extremity of the respective metallic portions and the second termination is connected to the electrical fire inhibiting device. The arrangement is configured so that when the heat sensitive device senses the potentially hazardous temperature rise, the jeweler's thread pulls the electrical fire inhibiting device for switching the fire inhibiting device from the dormant to the fire extinguishing mode.

In a specific embodiment of he present invention, a capillary tube defines a capillary for the slidable reception therein of the jeweler's thread so that when the first termination of the jeweler's thread is moved by the heat sensitive device, such movement is transmitted to the second termination of the jeweler's thread.

The electrical fire inhibiting device includes a canister which defines an enclosure and a neck portion. The enclosure contains a vaporous propellant, liquid propellant and foaming agent.

A mixing valve is disposed within the neck portion such that when the fire inhibiting device is disposed in the fire extinguishing mode, the vaporous propellant, liquid propellant and foaming agent are mixed by the mixing valve so that the mixed vaporous propellant, liquid propellant and foaming agent flow through the neck portion and past the mixing valve for extinguishing the electrical fire.

The electrical fire inhibiting device also includes an actuation valve which is disposed in a vicinity of the neck portion.

A spring is associated with the actuation valve so that when the spring is tripped, the actuation valve moves from an inoperative to an operative disposition thereof. The operative disposition of the actuation valve permits mixing of the vaporous propellant, liquid propellant and foaming agent such that the mixed vaporous propellant, liquid propellant and foaming agent flow through the neck portion for extinguishing the electrical fire.

More specifically, the spring is a compression spring which, when tripped, actuates the actuation valve.

In one embodiment of the present invention, the electrical box is an electrical circuit breaker box.

In another embodiment of the present invention, the electrical box is an electrical junction box.

In a further embodiment of the present invention, the electrical box is an electrical outlet box.

More specifically, the electrical outlet box includes a housing which defines a cavity for the reception therein of the heat sensitive device, the control device and the electrical fire inhibiting device. Also, a cover plate is fabricated from a material which changes color when heated in order to provide an additional visual warning of the potentially hazardous temperature rise within the electrical box caused by an electrical fault in the electrical box.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications would be the provision of an electronic device as the control device such that when the heat sensitive device senses the increased temperature, the electronic device controls the actuation valve by a servo mechanism or by a solenoid or the like so that the fire inhibiting device is switched to the fire extinguishing mode.

Also, in place of the "thermal strip actuator", an alternative includes a low melting pewter or other metallic, organic or synthetic material that melts and breaks between 225 degrees F., and 325 degrees F. under spring tension, as in the preferred embodiment, but being activated by melting and breaking, much like an air duct fire damper or the soft metallic substance used in older commercial fire sprinkler heads.

BRIEF DESCRIPTION OF THE DRAWINGS

Similar reference characters refer to similar parts throughout the various views of the drawings.

DETAILED DESCRIPTION OF THE DRAWINGS

Figure 1:
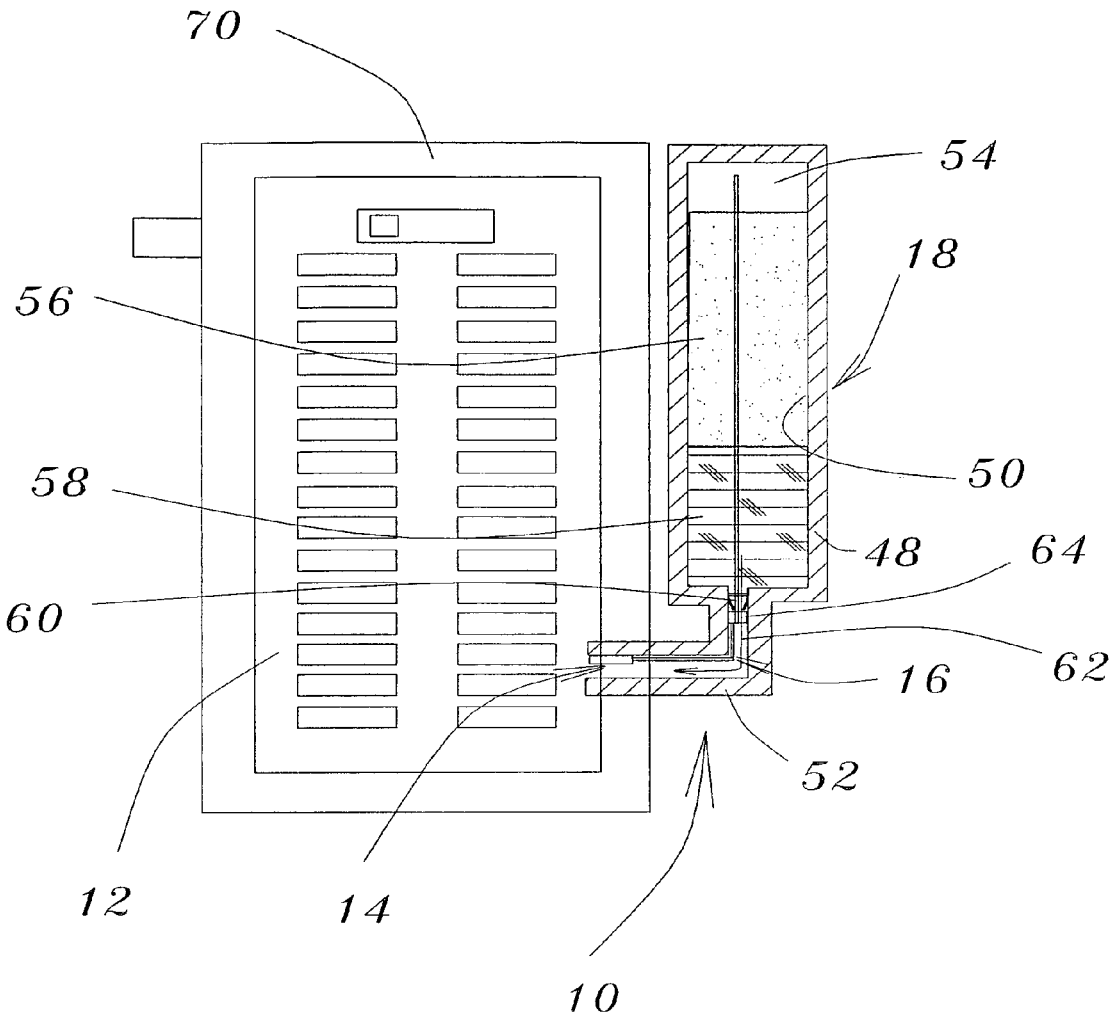
FIG. 1 is a side elevational view of a safety apparatus according to the present invention for inhibiting an outbreak of an electrical fire within an electrical box.

FIG. 1 is a side elevational view of a safety apparatus generally designated 10, according to the present invention, for inhibiting an outbreak of an electrical fire within an electrical box 12. As shown in FIG. 1, the apparatus 10 includes a heat sensitive device generally designated 14 which is disposed within the electrical box 12 for sensing a potentially hazardous temperature rise within the electrical box 12 caused by an electrical fault in the electrical box 12. A control device generally designated 16 is associated with the heat sensitive device 14 such that the control device 16 is activated by the heat sensitive device 14 when the heat sensitive device 14 senses the potentially hazardous temperature rise within the electrical box 12. An electrical fire inhibiting device generally designated 18 is operably connected to the control device 16. The electrical fire inhibiting device 18 has a dormant mode and a fire extinguishing mode. The arrangement is such that when the control device 16 is activated by the heat sensitive device 14, the control device 16 switches the fire inhibiting device 18 from the dormant mode to the fire extinguishing mode so that the outbreak of the electrical fire within the electrical box 12 is prevented.

Figure 2:
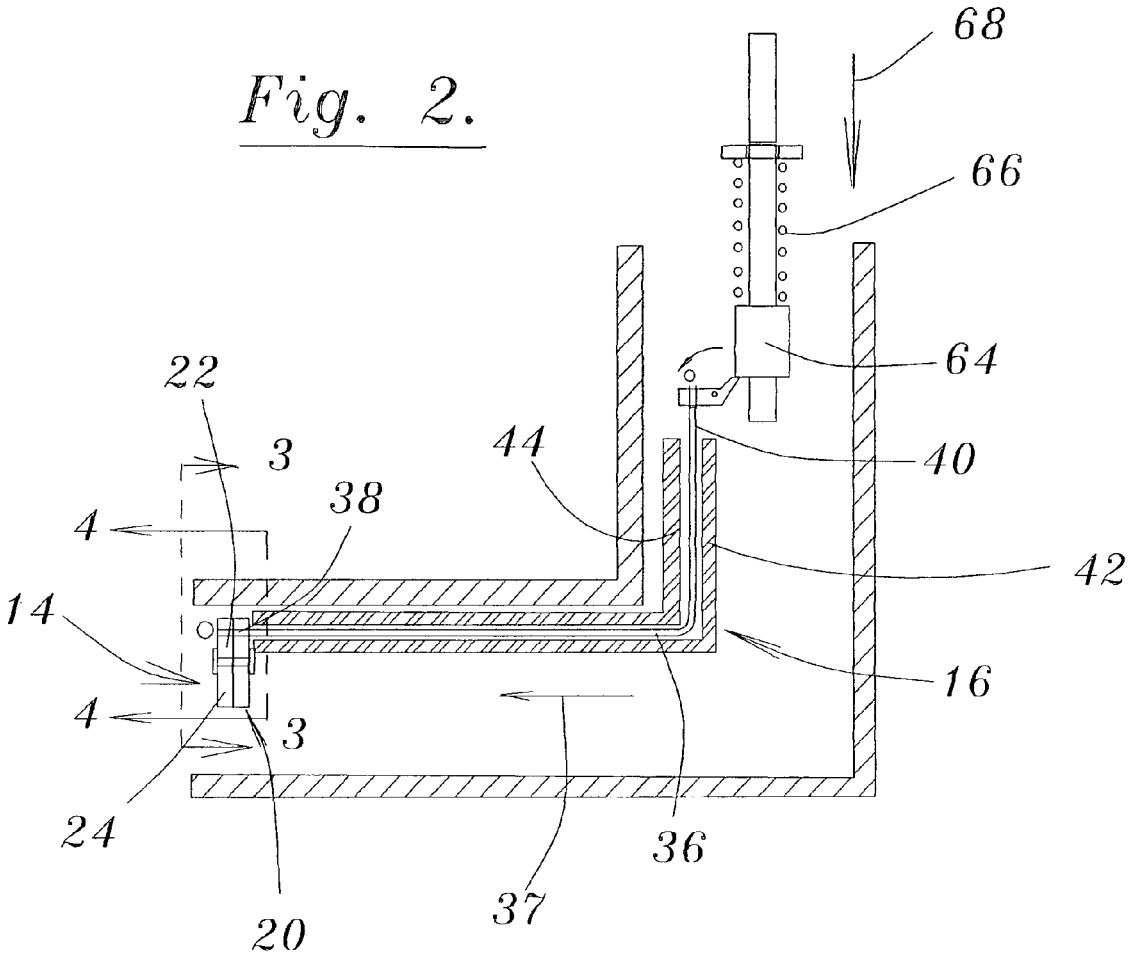
FIG. 2 is an enlarged view of the apparatus shown in FIG. 1.

FIG. 2 is an enlarged view of the apparatus 10 shown in FIG. 1. As shown in FIG. 2, the heat sensitive device 14 includes a bimetallic strip generally designated 20 which warps in response to the potentially hazardous temperature rise within the electrical box 12.

More specifically, the heat sensitive device 14 includes a thermal strip 22, the thermal strip 22 including a first metallic portion 24.

Figure 3:
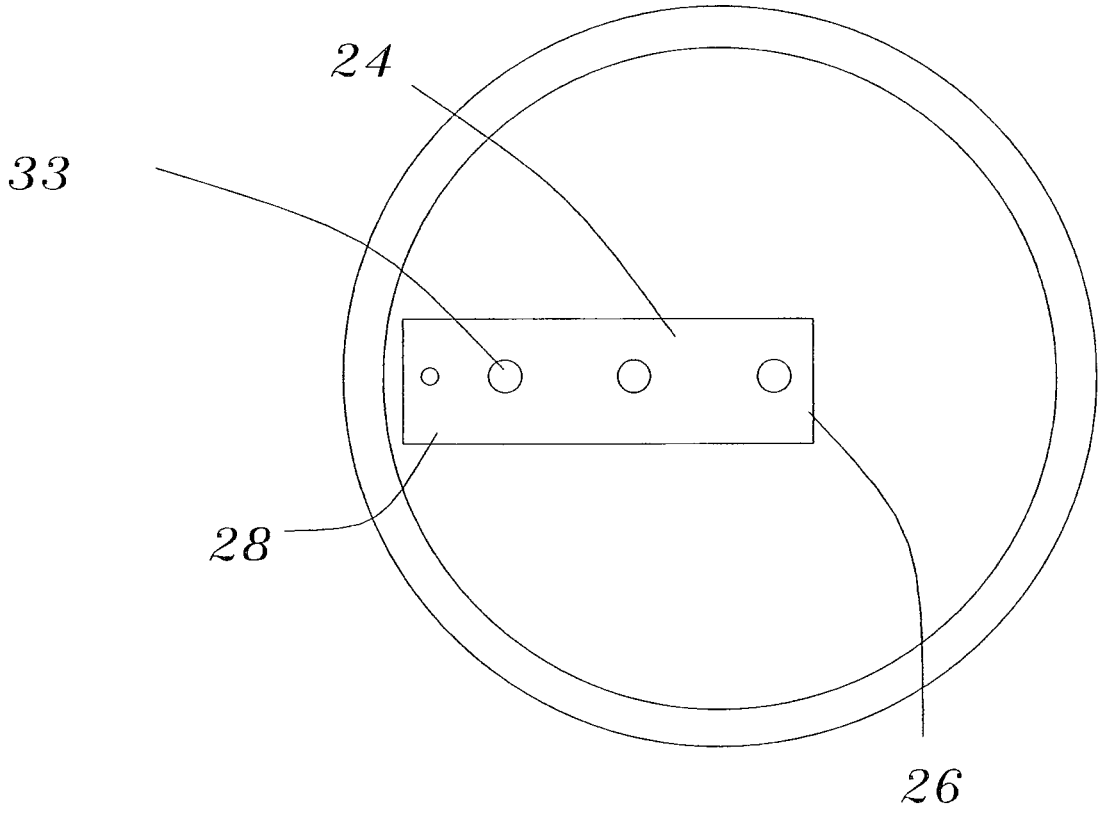
FIG. 3 is an enlarged view taken on the line 3-3 of FIG. 2.

FIG. 3 is an enlarged view taken on the line 3-3 of FIG. 2. As shown in FIG. 3, the first metallic portion 24 has a first and a second end 26 and 28 respectively.

Figure 4:
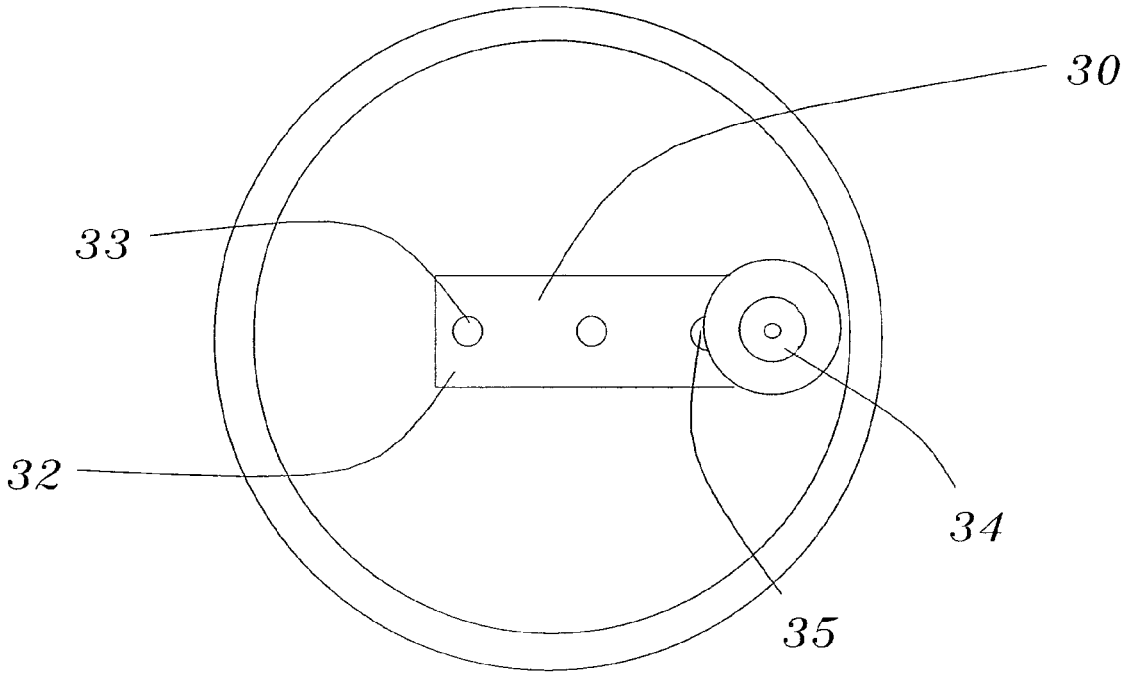
FIG. 4 is an enlarged view taken on the line 4-4 of FIG. 2.

FIG. 4 is an enlarged view taken on the line 4-4 of FIG. 2. As shown in FIG. 4, a second metallic portion 30 is fabricated from a metal having a different coefficient of thermal expansion relative to a coefficient of thermal expansion of the first metallic portion 24. The second portion 30 has a first and a second extremity 32 and 34 respectively. The arrangement is such that the first end 26 of the first metallic portion 24 and the first extremity 32 of the second metallic portion 30 are joined together by a rivet 33 or the like. Also, the second end 28 of the first metallic portion 24 and the second extremity 34 of the second metallic portion 30 are joined together by a further rivet 35. The arrangement is such that when the potentially hazardous temperature rise is present within the electrical box 12, the first and second metallic portions 24 and 30 respectively warp in response to the potentially hazardous temperature rise within the electrical box 12 due to the difference in the coefficients of thermal expansion of the respective portions.

The control device 16 shown in FIGS. 1 and 2 includes jeweler's thread 36 having a first and a second termination 38 and 40 respectively. The first termination 38 of the jeweler's thread 36 is connected to the heat sensitive device 14 adjacent to the end and extremity 28 and 34 of the portions 24 and 30 respectively. The second termination 40 is connected to the electrical fire inhibiting device 18. The arrangement is configured so that when the heat sensitive device 14 senses the potentially hazardous temperature rise, the jeweler's thread 36 pulls on the electrical fire inhibiting device 18, as indicated by the arrow 37 for switching the fire inhibiting device 18 from the dormant mode to the fire extinguishing mode.

More particularly, a capillary tube 42 defines a capillary 44 for the slidable reception therein of the jeweler's thread 36 so that when the first termination 38 of the jeweler's thread is moved by the heat sensitive device 14, such movement as indicated by the arrow 37 is transmitted to the second termination 40 of the jeweler's thread 36.

As shown in FIG. 1, the electrical fire inhibiting device 18 includes a canister 48 which defines an enclosure 50 and a neck portion 52. The enclosure 50 contains a vaporous propellant 54, liquid propellant 56 and foaming agent 58.

A mixing valve 60 is disposed within the neck portion 52 such that when the fire inhibiting device 18 is disposed in the fire extinguishing mode, the vaporous propellant 54, liquid propellant 56 and foaming agent 58 are mixed by the mixing valve 60 so that the mixed vaporous propellant 54, liquid propellant 56 and foaming agent 58 flow as indicated by the arrow 62 through the neck portion 52 and past the mixing valve 60 for extinguishing the electrical fire.

The electrical fire inhibiting device 18 also includes an actuation valve 64 which is disposed in a vicinity of the neck portion 52.

As shown in FIG. 2, a spring 66 is associated with the actuation valve 64 so that when the spring 66 is tripped, the actuation valve 64 moves as indicated by the arrow 68.

As shown in FIG. 2, the actuation valve 64 is in an inoperative disposition.

Figure 5:
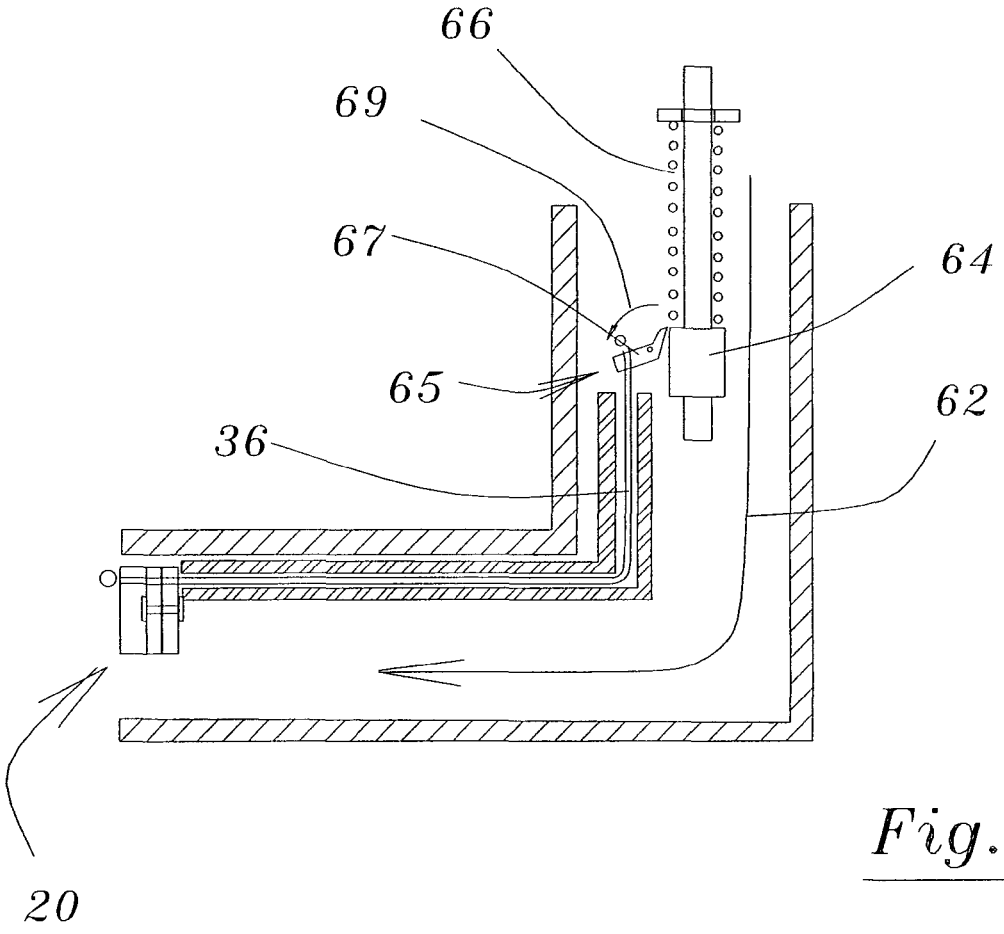
FIG. 5 is a similar view to that shown in FIG. 2, but shows the actuation valve tripped to an operative disposition thereof.

FIG. 5 is a similar view to that shown in FIG. 2, but shows the actuation valve 64 tripped to an operative disposition thereof. The operative disposition of the actuation valve 64 as shown in FIG. 5 permits mixing of the vaporous propellant 54, liquid propellant 56 and foaming agent 58 such that the mixed vaporous propellant 54, liquid propellant 56 and foaming agent 58 flow through the neck portion 52, as shown by the arrow 62, for extinguishing the electrical fire.

More specifically, the spring is a compression spring which when tripped, actuates the actuation valve 64.

As shown in FIGS. 2 and 5, the tripping mechanism generally designated 65 includes a pivoted catch 67 which when pulled by the jeweler's thread 36, pivots as indicated by the arrow 69 so that the compression spring 66 urges the actuation valve 64 from the inoperative disposition shown in FIG. 2 to the operative disposition thereof shown in FIG. 5.

In one embodiment of the present invention as shown in FIGS. 1-5, the electrical box 12 is an electrical circuit breaker box 70.

Figure 6:
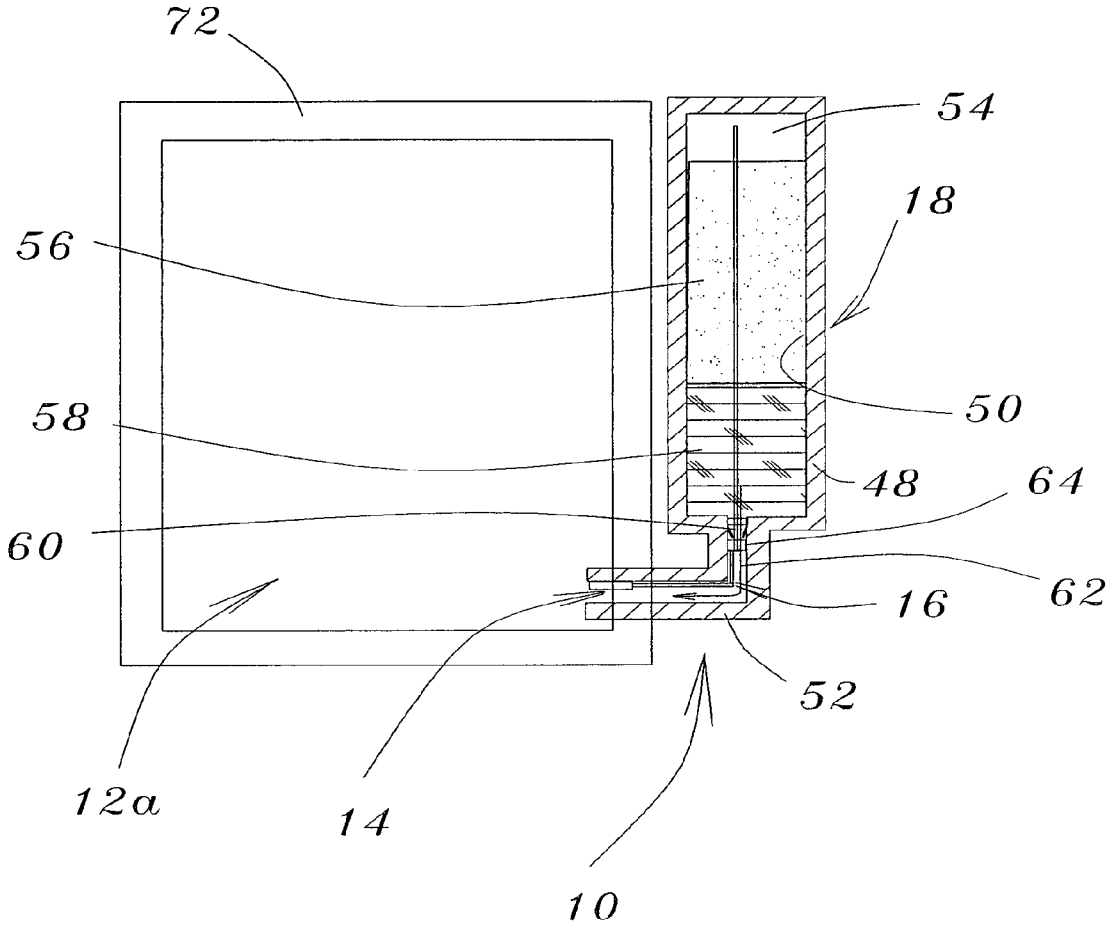
FIG. 6 is a side elevational view of another embodiment of the present invention.

FIG. 6 is a side elevational view of another embodiment of the present invention. As shown in FIG. 6, the electrical box 12*a* is an electrical junction box 72.

Figure 7:
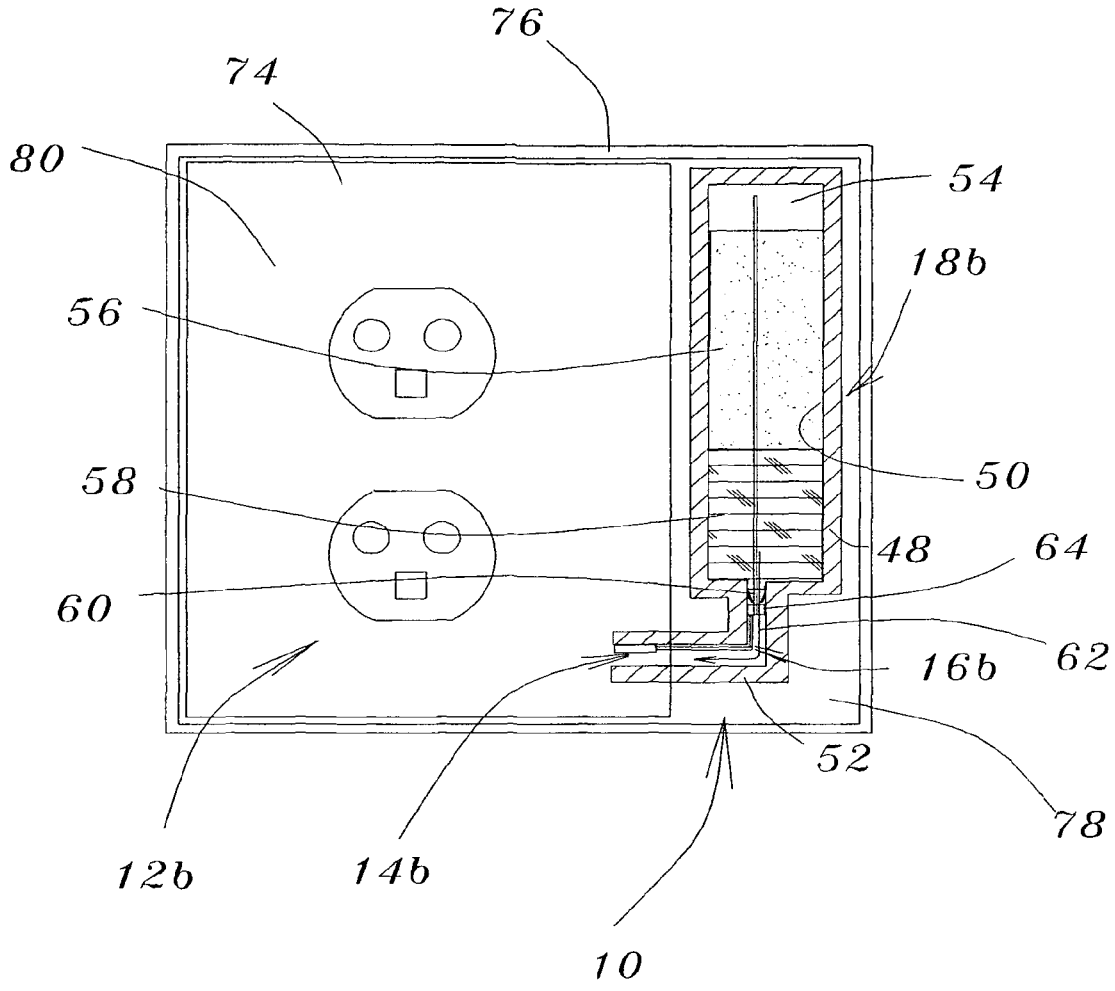
FIG. 7 is a side elevational view of a further embodiment of the present invention.

FIG. 7 is a side elevational view of a further embodiment of the present invention. As shown in FIG. 7, the electrical box 12*b* is an electrical outlet box 74.

More specifically, the electrical outlet box 74 includes a housing 76 which defines a cavity 78 for the reception therein of the heat sensitive device 14*b*, the control device 16*b* and the electrical fire inhibiting device 18*b*. Also, a cover plate 80 is fabricated from a material which changes color when heated in order to provide an additional visual warning of the potentially hazardous temperature rise within the electrical box 12*b* caused by an electrical fault in the electrical box 12*b*.

In operation of the apparatus 10 according to the present invention, when a faulty electrical connection is present in the electrical box 12, heat is generated. This heat is sensed by the heat sensitive device 14 so that the bimetallic strip 20 warps. Such warping of the bimetallic strip 20 is shown in FIG. 5. The arrangement is such that the riveted second end 28 and second extremity 34 of the strip 20 moves or pulls the jeweler's thread 36 for tripping the actuation valve 64 of the electrical fire inhibiting device 18 thus switching the device 18 from the dormant mode to the fire extinguishing mode.

The present invention provides a unique system for preventing the outbreak of an electrical fire.

What is claimed is:

1. A safety apparatus for inhibiting an outbreak of an electrical fire within an electrical box, said apparatus comprising:

a heat sensitive device disposed within the electrical box for sensing a potentially hazardous temperature rise within the electrical box caused by an electrical fault in the electrical box;

said heat sensitive device includes:

a bimetallic strip which warps in response to said potentially hazardous temperature rise within the electrical box;

a control device associated with said heat sensitive device such that said control device is activated by said heat sensitive device when said heat sensitive device senses said potentially hazardous temperature rise within the electrical box;

an electrical fire inhibiting device operably connected to said control device, said electrical fire inhibiting device having a dormant mode and a fire extinguishing mode such that when said control device is activated by said heat sensitive device, said control device switches said fire inhibiting device from said dormant mode to said fire extinguishing mode so that the outbreak of the electrical fire within the electrical box is prevented;

said electrical fire inhibiting device including:

a canister which defines an enclosure and a neck portion;

said enclosure containing a vaporous propellant, liquid propellant and foaming agent; and a mixing valve disposed within said neck portion such that when said fire inhibiting device is disposed in said fire extinguishing mode, said vaporous propellant, liquid propellant and foaming agent are mixed by said mixing valve so that said mixed vaporous propellant, liquid propellant and foaming agent flow through said neck portion and past said mixing valve for extinguishing the electrical fire.

2. A safety apparatus as set forth in claim 1 wherein said heat sensitive device includes:

a thermal strip;

said thermal strip including:

a first metallic portion having a first and a second end;

a second metallic portion fabricated from a metal having a different coefficient of thermal expansion relative to a coefficient of thermal expansion of said first metallic portion, said second portion having a first and a second extremity, the arrangement being such that said first end of said first metallic portion and said first extremity of said second metallic portion are joined together and said second end of said first metallic portion and said second extremity of said second metallic portion are joined together so that when said potentially hazardous temperature rise is present within the electrical box, said first and second metallic portions warp in response to said potentially hazardous temperature rise within the electrical box due to said difference in said coefficients of thermal expansion of said metallic portions.

3. A safety apparatus as set forth in claim 1 wherein said control device includes:

jeweler's thread having a first and a second termination, said first termination of said jeweler's thread being connected to said heat sensitive device, said second termination being connected to said electrical fire inhibiting device so that when said heat sensitive device senses said potentially hazardous temperature rise, said jeweler's thread pulls said electrical fire inhibiting device for switching said fire inhibiting device from said dormant to said fire extinguishing mode.

4. A safety apparatus as set forth in claim 3 further including:

a capillary tube defining a capillary for the slidable reception therein of said jeweler's thread so that when said first termination of said jeweler's thread is moved by said heat sensitive device, such movement is transmitted to said second termination of said jeweler's thread.

5. A safety apparatus as set forth in claim 1 wherein said electrical fire inhibiting device includes:

an actuation valve disposed in a vicinity of said neck portion.

6. A safety apparatus as set forth in claim 5 further including:

a spring associated with said actuation valve so that when said spring is tripped, said actuation valve moves from an inoperative to an operative disposition thereof, said operative disposition of said actuation valve permitting mixing of said vaporous propellant, liquid propellant and foaming agent such that said mixed vaporous propellant, liquid propellant and foaming agent flow through said neck portion for extinguishing said electrical fire.

7. A safety apparatus as set forth in claim 6 wherein said spring is a compression spring which when tripped, actuates said actuation valve.

8. A safety apparatus as set forth in claim 1 wherein the electrical box is an electrical circuit breaker box.

9. A safety apparatus as set forth in claim 1 wherein the electrical box is an electrical junction box.

10. A safety apparatus as set forth in claim 1 wherein the electrical box is an electrical outlet box.

11. A safety apparatus as set forth in claim 10 wherein said electrical outlet box includes:

a housing defining a cavity for the reception therein of said heat sensitive device, said control device and said electrical fire inhibiting device;

a cover plate fabricated from a material which changes color when heated in order to provide an additional visual warning of the potentially hazardous temperature rise within the electrical box caused by an electrical fault in the electrical box.

12. A safety apparatus for inhibiting an outbreak of an electrical fire within an electrical box, said apparatus comprising:

a heat sensitive device disposed within the electrical box for sensing a potentially hazardous temperature rise within the electrical box caused by an electrical fault in the electrical box;

a control device associated with said heat sensitive device such that said control device is activated by said heat sensitive device when said heat sensitive device senses said potentially hazardous temperature rise within the electrical box;

an electrical fire inhibiting device operably connected to said control device, said electrical fire inhibiting device having a dormant mode and a fire extinguishing mode such that when said control device is activated by said heat sensitive device, said control device switches said fire inhibiting device from said dormant mode to said fire extinguishing mode so that the outbreak of the electrical fire within the electrical box is prevented;

said heat sensitive device including:

a bimetallic strip which warps in response to said potentially hazardous temperature rise within the electrical box;

said control device including:

jeweler's thread having a first and a second termination, said first termination being connected to said heat sensitive device, said second termination being connected to said electrical fire inhibiting device so that when said heat sensitive device senses said potentially hazardous temperature rise, said jeweler's thread pulls said electrical fire inhibiting device for switching said fire inhibiting device from said dormant to said fire extinguishing mode;

a capillary tube defining a capillary for the slidable reception therein of said jeweler's thread so that when said first termination of said jeweler's thread is moved by said heat sensitive device, such movement is transmitted to said second termination of said jeweler's thread;

said electrical fire inhibiting device including:

a canister which defines an enclosure and a neck portion;

said enclosure containing a vaporous propellant, liquid propellant and foaming agent;

a mixing valve disposed within said neck portion such that when said fire inhibiting device is disposed in said fire extinguishing mode, said vaporous propellant, liquid propellant and foaming agent are mixed by said mixing valve so that said mixed vaporous propellant, liquid propellant and foaming agent flow through said neck portion and past said mixing valve for extinguishing the electrical fire;

an actuation valve disposed in a vicinity of said neck portion;

a spring associated with said actuation valve so that when said spring is tripped, said actuation valve moves from an inoperative to an operative disposition thereof, said operative disposition of said actuation valve permitting mixing of said vaporous propellant, liquid propellant and foaming agent such that said mixed vaporous propellant, liquid propellant and foaming agent flow through said neck portion for extinguishing said electrical fire; and said spring being a compression spring which when tripped, actuates said actuation valve.

* * * * *